US008915370B2

(12) United States Patent
Prinsen et al.

(10) Patent No.: US 8,915,370 B2
(45) Date of Patent: Dec. 23, 2014

(54) BLISTER-TYPE PACKAGING UNIT HAVING A WEAKENED REGION TO BE TORN

(75) Inventors: Niels Arno Prinsen, Drachten (NL); Rhonda Kay Parton, Eindhoven (NL); Clay Steven Stricklin, Eindhoven (NL); Caroline Van Hoff-Brekelmans, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 13/121,194

(22) PCT Filed: Sep. 28, 2009

(86) PCT No.: PCT/IB2009/054236

§ 371 (c)(1), (2), (4) Date: Mar. 28, 2011

(87) PCT Pub. No.: WO2010/038185

PCT Pub. Date: Apr. 8, 2010

(65) Prior Publication Data

US 2011/0174808 A1 Jul. 21, 2011

(30) Foreign Application Priority Data

Oct. 2, 2008 (EP) ..... 08165686

(51) Int. Cl.
*B65D 73/00* (2006.01)
*B65D 75/36* (2006.01)

(52) U.S. Cl.
CPC ..... *B65D 75/366* (2013.01); *B65D 2575/367* (2013.01); *B65D 2577/2091* (2013.01); *B65D 2577/2066* (2013.01)
USPC ..... 206/469; 206/467; 206/461; 206/470; 206/532

(58) Field of Classification Search
CPC ..... B65D 73/0057; B65D 73/0092; B65D 75/36; B65D 75/326; B65D 75/325; B65D 75/32
USPC ..... 206/469, 467, 461, 470, 532
See application file for complete search history.

(56) References Cited

U.S. PATENT DOCUMENTS

| | | | | |
|---|---|---|---|---|
| 3,121,493 | A | 2/1964 | Snape | |
| 3,246,747 | A * | 4/1966 | Blish | 206/462 |
| 3,970,194 | A | 7/1976 | Iten | |
| 4,011,949 | A | 3/1977 | Braber et al. | |

(Continued)

FOREIGN PATENT DOCUMENTS

| | | | |
|---|---|---|---|
| EP | 0844193 | A1 | 5/1998 |
| EP | 1867580 | A1 | 12/2007 |

(Continued)

*Primary Examiner* — Anthony Stashick
*Assistant Examiner* — Blaine Neway

(57) ABSTRACT

A blister-type packaging unit having a front wall (2) and a rear wall (1) defining an article-receiving space (6) between them. The front wall (2) and the rear wall (1) have a circumferential joint (4). Inwardly of said circumferential joint (4) a weakened region (7) is present in at least one of the front and rear walls (1,2), which weakened region (7) is tearable by a user to separate the front and rear walls (1,2). Said weakened region (7) has two end portions which are located inwardly of said peripheral region, so that the weakened region (7) can be torn after the user has made a cut in the walls (1,2).

9 Claims, 2 Drawing Sheets

(56) References Cited

U.S. PATENT DOCUMENTS

| | | | | |
|---|---|---|---|---|
| 4,200,193 | A * | 4/1980 | Boyle | 206/461 |
| 5,443,154 | A * | 8/1995 | Hustad et al. | 206/213.1 |
| 5,613,349 | A * | 3/1997 | Brown | 53/453 |
| 5,839,609 | A | 11/1998 | Zakensberg | |
| 6,016,914 | A * | 1/2000 | Gustafson | 206/470 |
| 6,155,414 | A * | 12/2000 | Vaessen | 206/232 |
| 6,543,209 | B1 | 4/2003 | Siegel et al. | |
| 7,789,233 | B2 * | 9/2010 | Levy et al. | 206/459.5 |
| 8,091,704 | B2 * | 1/2012 | Trigg | 206/469 |
| 2002/0185401 | A1 * | 12/2002 | Duquet et al. | 206/461 |
| 2004/0202750 | A1 | 10/2004 | Versluys | |
| 2007/0284279 | A1 | 12/2007 | Doskoczynski et al. | |

FOREIGN PATENT DOCUMENTS

| | | | |
|---|---|---|---|
| FR | 2751632 | A1 | 1/1998 |
| JP | 2005126103 | A | 5/2005 |
| JP | 2006027657 | A | 2/2006 |
| JP | 2006027715 | A | 2/2006 |
| JP | 2008068923 | A | 3/2008 |
| WO | 9903751 | A1 | 1/1999 |
| WO | 0102265 | A1 | 1/2001 |
| WO | 0160711 | A1 | 8/2001 |
| WO | 03010065 | A1 | 2/2003 |

* cited by examiner

BLISTER-TYPE PACKAGING UNIT HAVING A WEAKENED REGION TO BE TORN

FIELD OF THE INVENTION

The invention relates to a blister-type packaging unit having a front wall and a rear wall defining an article-receiving space between them, wherein the front wall and the rear wall have a circumferential joint along at least a main portion of a peripheral region of the front and rear walls, and wherein inwardly of said circumferential joint a weakened region is present in at least one of the front and rear walls along a part of the circumferential joint, which weakened region is tearable by a user to separate the front and rear walls in order to access said article-receiving space.

BACKGROUND OF THE INVENTION

Such a blister-type packaging unit is disclosed in WO-A-01/60711. This publication describes a packaging unit having a so called tear-open strip comprising a part of the circumferential joint. The tear open strip is connected with a remainder part of the packaging unit by a weakened region in both the front wall and the rear wall. The tear-open strip can be separated from the packaging unit by tearing the weakened region by the user. Subsequently, the packaging unit can be easily opened in order to remove the article from the packaging unit.

SUMMARY OF THE INVENTION

The material of the walls can be plastic and/or cardboard or any other material or combination of materials that can surround the article to be packed. The material can be elastic in order to be formed around the article, or one or both walls may have a recessed part to accommodate the article. Preferably, the rear wall of the packaging unit is substantially flat. At least one of the walls, preferably the front wall, is made of transparent plastic, so that the article is shown. Apart from the article, a cardboard or paper sheet may be present in the packaging unit, for example to indicate how to open the packaging unit and/or to give instructions about the use of the article and/or to give a specification of it.

The circumferential joint can be welded with a heat seal near the edges of the two walls, or the walls can be glued together or fixed to each other in any other way in the peripheral region. Furthermore, a part of the circumferential joint may consist of a fold of the material of the walls in case the two walls are made out of one piece of material.

The blister-type packaging unit according to said WO-A-01/60711 is easy to open. Therefore, the packaging unit can be opened in order to take away the article from a shop without the theft protection that may be present in the packaging unit. On the other hand, in order to achieve theft protection, a blister-type packaging unit is often hard to open. This is a disadvantage, because it is preferred that the article can be removed from the packaging unit in an easy way after the article in the packaging unit is bought and taken home by the user.

An object of the invention is a blister-type packaging unit that can be easily opened by means of a pair of scissors, but whereby the packaging unit is difficult to open without making use of such a tool.

Another object of the invention is a blister-type packaging unit whereby the front wall and the rear wall of the packaging unit can easily be separated by the user's finger r who is opening the packaging unit.

In order to accomplish one or both these objects, a blister-type packaging unit according to the invention is characterized in that said weakened region has two end portions which are located inwardly of said peripheral region, whereby the weakened region can be torn by the user after the user has made a cut in the front and rear walls starting from said peripheral region through said two end portions of said weakened region. The weakened region may consist of perforations in both said front and rear walls or in one of the front and rear walls, preferably only in the rear wall of the packaging unit. Because the weakened region does not extend to the peripheral region of the packaging unit, it is only possible to tear the weakened region after making a cut starting from said peripheral region towards and through said end portions of the weakened region. In this manner, only a simple tool like a pair of scissors is required to open the packaging unit, but once a relative simple cut is made, the packaging unit can be opened by tearing the material of at least one of the walls.

In a preferred embodiment, two weakened regions are present located in opposite parts of the peripheral region of the packaging unit, wherein a cutting line near a further part of the peripheral region between said opposite parts crosses both weakened regions. In this manner, when the packaging unit has a substantially rectangular shape, a cut with a pair of scissors along one of the four sides of the rectangle is sufficient to open the packaging unit at three of the four sides, whereby the article is free to be removed from the packaging unit.

In a preferred embodiment, the cutting line is indicated on one of the front and rear walls, preferably on the rear wall, or on a sheet of material between the front and rear walls, wherein the cutting line crosses at least one weakened region. The cutting line can be indicated by a dotted line provided with the image of a pair of scissors, so that it is clear to the user how to open the packaging unit.

In a preferred embodiment, a notch in the peripheral region of the packaging unit is present at a location where said cutting line passes the peripheral region, i.e. the location where a cut has to be made through the peripheral region. Such a notch facilitates the making of a cut by means of a pair of scissors. Preferably, a notch is present at both ends of the cutting line.

In a preferred embodiment, in order to hang up the packaging unit, for example in a display, a slot-like opening is present in the front and rear walls. Preferably, said slot-like opening extends along a part of the cutting line, i.e. the cutting line crosses the slot-like opening. In this manner, the length of the cut to be made for opening the packaging unit is shortened, only the walls at both ends of the slot-like opening have to be cut.

In a preferred embodiment, in one of the front and rear walls, preferably in the rear wall, said opening is larger than in the other of the front and rear walls, whereby separation of the front and rear walls by the user's finger is facilitated after the user has made a cut along the cutting line through the slot-like opening. Preferably, a larger part of the opening in one of the front and rear walls overlaps a recessed part of the other wall, so that a finger can easily be inserted in said recessed part through said opening.

BRIEF DESCRIPTION OF THE DRAWING

The invention will now be further elucidated by means of a description of an embodiment of a blister-type packaging unit according to the invention, wherein reference is made to the drawing comprising diagrammatical figures, wherein.

DETAILED DESCRIPTION OF AN EMBODIMENT

Figure 1:
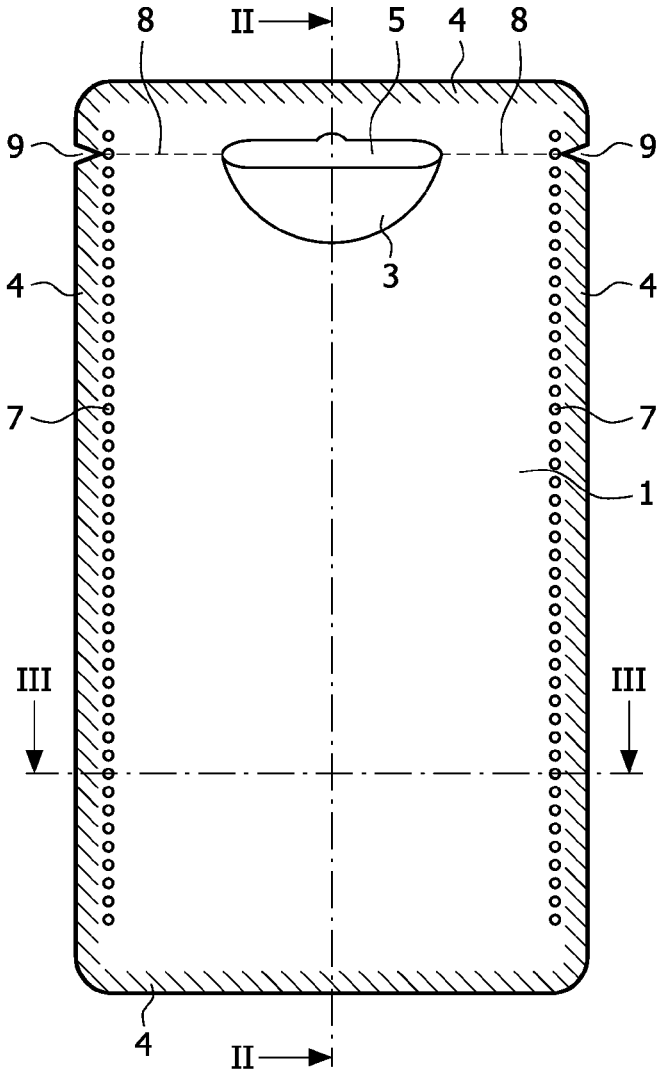
FIG. 1 is a rear view of the packaging unit.

FIG. 1 shows the rear side of the blister-type packaging unit. The rear wall 1 has an opening 3 through which opening a part of the front wall 2 of the packaging unit is visible. The rear wall 1 is flat and has a substantially rectangular shape. Both walls, the rear wall 1 and the front wall 2, are made of plastic, whereby the front wall 2 is transparent. The rear wall 1 is welded to the front wall 2 by means a heat seal 4 in the peripheral region of the packaging unit, forming a circumferential joint of the two walls 1,2. The location of the heat seal 4 is indicated in FIG. 1 by means of an area shaded by parallel lines. At the top of the packaging unit is a horizontal slot-like opening 5 in order to hang up the packaging unit in a display. The slot-like opening 5 is present in the front wall 2 and corresponds with a part of opening 3 in the rear wall 1. The other part of opening 3 in the rear wall 1 extends in the downward direction (see FIGS. 1 and 2).

Figure 3:
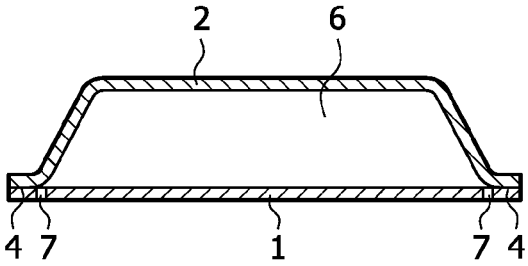
FIG. 3 is a sectional view according to the line III-III in FIG. 1.
Figure 2:
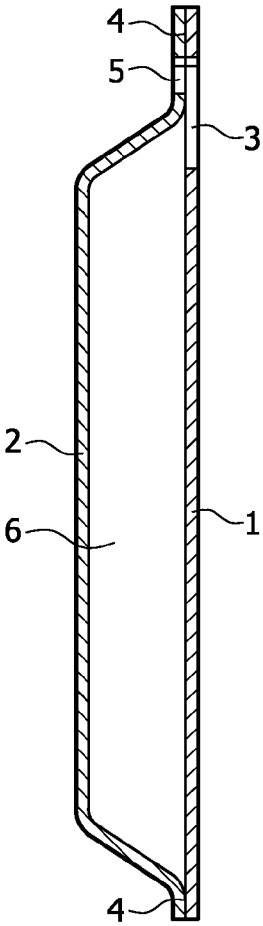
FIG. 2 is a sectional view according to the line II-II in FIG. 1.

FIGS. 2 and 3 are sectional views of the packaging unit showing the article receiving space 6 between the flat rear wall 1 and a recessed part of the front wall 2. The recessed part of the front wall 2 may have any shape, which shape can be adapted to the shape of the article in the article receiving space 6.

The rear wall 1 comprises two weakened regions 7 near opposite parts of its peripheral region. The weakened regions 7 are created by two straight arrays of perforations through the material of the rear wall 1. Furthermore, the rear wall 1 is provided with a dashed line 8 indicating the cutting line, i.e. the line to be cut by means of a pair of scissors when opening the packaging unit. Two notches 9 in both walls 1,2 at the ends of the cutting line 8 facilitate the cutting operation when the user is opening the packaging unit.

After the user has cut along the cutting line 8, he can easily insert his finger through opening 3 of the rear wall 1 because behind opening 3 is the recessed part of the front wall 2. Then he can tear the weakened regions 7 of the rear wall 1, so that the packaging unit is opened and the packed article can be removed out of the packaging unit.

Figure 4:
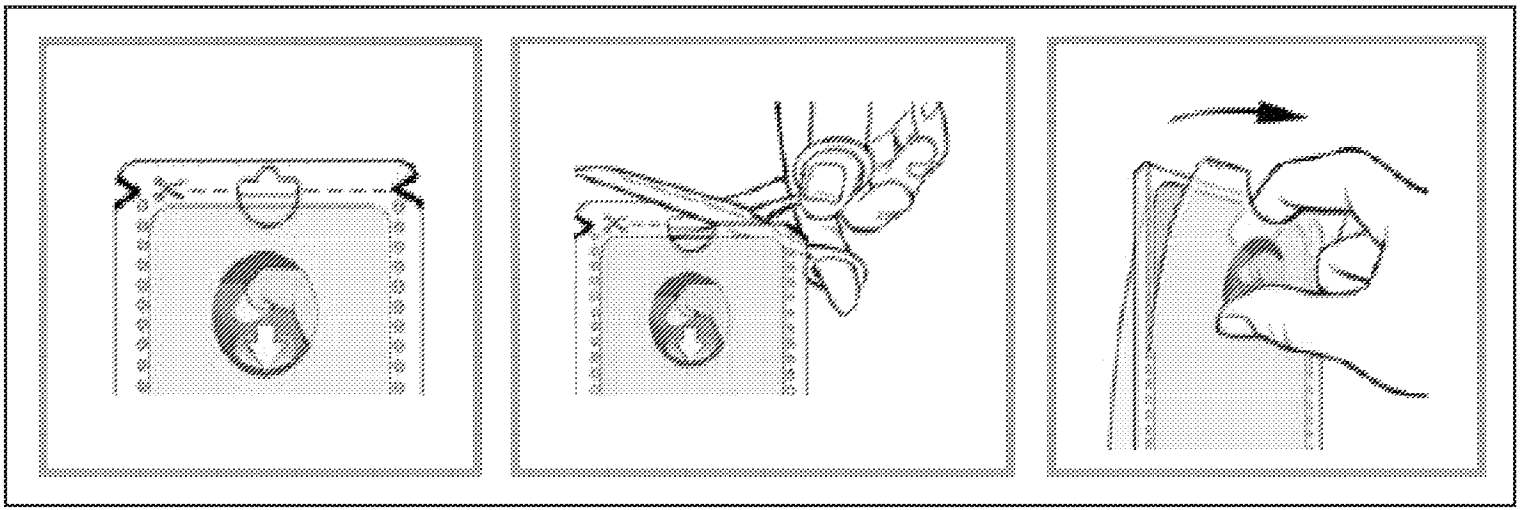
FIG. 4 shows instructions for opening the packaging unit.

FIG. 4 shows how to open the blister-type packaging unit according to the FIGS. 1-3. These instructions can be represented on the rear wall 1 in order to elucidate the opening operation for the person who opens the packaging unit. It shows how to cut the cutting line by means of a pair of scissors and how to insert the finger in order to tear the weakened regions.

While the invention has been illustrated in the drawing and the foregoing description, such an illustration and description are to be considered illustrative or exemplary and not restrictive; the invention is not limited to the disclosed embodiment. The mere fact that certain measures are recited in mutually different dependent claims does not indicate that a combination of these measures cannot be used to advantage. Any reference signs in the claims should not be construed as limiting the scope of the invention.

The invention claimed is:

1. A blister-type packaging unit, comprising:

a single layer front wall, and a single layer rear wall defining an article-receiving space between them, whereby both the front and rear walls are made of plastic and the front wall is transparent, the front wall comprised of a single section defining a front face of the blister-type packaging unit and the rear wall comprised of a single section defining a rear face of the blister-type packaging unit, a horizontal slot-like opening located in the front wall having a corresponding opening in the rear wall extending in a downward direction, wherein the front wall and the rear wall have a circumferential joint along at least a main portion of a peripheral region of the front and rear walls, wherein inwardly of said circumferential joint one or both of said walls includes weakened regions consisting of a first weakened region and a second weakened region located in opposite parts of the peripheral region being separated there-between by a non-weakened region, wherein said first and second weakened regions each respectively have end portions which are located inwardly of said circumferential joint, wherein a cutting line near a further part of the peripheral region between said opposite parts crosses both of said first and second weakened regions in said opposite parts of the peripheral region, wherein the horizontal slot-like opening centrally bifurcates said cutting line thereby providing an opening to allow a user to insert a finger through said corresponding opening in the rear wall, wherein said first and second weakened regions are tearable by said user to separate the front and rear walls in order to access said article-receiving space, and wherein the first and second weakened regions can be separately torn by the user after the user has made a cut along the cutting line in the front and rear walls starting from said peripheral region through said two end portions of said first and second weakened regions.

2. A packaging unit as claimed in claim 1, wherein the cutting line is indicated on one of the front and rear walls.

3. A packaging unit as claimed in claim 2, wherein a notch in the peripheral region is present at a location where said cutting line passes the peripheral region.

4. A packaging unit as claimed in claim 2, wherein the slot-like opening is present in the front and rear walls, wherein said slot-like opening extends along a part of the cutting line.

5. A packaging unit as claimed in claim 4, wherein in one of the front and rear walls said opening is larger than in the other of the front and rear walls.

6. A packaging unit as claimed in claim 5, wherein a larger part of the opening in one of the front and rear walls overlaps a recessed part of the other wall.

7. A packaging unit as claimed in claim 1, wherein said first weakened region extends from a first end point located in a bottom left hand portion of the peripheral region of the front and rear walls and extends to a second end point located in a top left hand portion of the peripheral region.

8. A packaging unit as claimed in claim 1, wherein said second weakened region extends from a first end point located in a bottom right hand portion of the peripheral region of the front and rear walls and extends to a second end point located in a top right hand portion of the peripheral region.

9. A packaging unit as claimed in claim 1, wherein said first and second weakened regions include respective first and second end points which terminate in a non-weakened region.

* * * * *